US009728913B2

(12) United States Patent
Tong et al.

(10) Patent No.: US 9,728,913 B2
(45) Date of Patent: Aug. 8, 2017

(54) APPARATUS FOR RECEIVING A PLUG TO FORM AN ELECTRICAL CONNECTION, A METHOD

(71) Applicant: Nokia Technologies Oy, Espoo (FI)

(72) Inventors: Guowen Tong, Beijing (CN); Xuewu Zhao, Beijing (CN)

(73) Assignee: Nokia Technologies Oy, Espoo (FI)

( * ) Notice: Subject to any disclaimer, the term of this patent is extended or adjusted under 35 U.S.C. 154(b) by 93 days.

(21) Appl. No.: 14/646,628

(22) PCT Filed: Dec. 6, 2012

(86) PCT No.: PCT/CN2012/086051
§ 371 (c)(1),
(2) Date: May 21, 2015

(87) PCT Pub. No.: WO2014/086025
PCT Pub. Date: Jun. 12, 2014

(65) Prior Publication Data

US 2015/0288114 A1 Oct. 8, 2015

(51) Int. Cl.
*H01R 24/58* (2011.01)
*H01R 13/193* (2006.01)
(Continued)

(52) U.S. Cl.
CPC ..... *H01R 24/58* (2013.01); *H01R 12/82* (2013.01); *H01R 13/193* (2013.01);
(Continued)

(58) Field of Classification Search
CPC .. H01R 12/82; H01R 13/193; H01R 23/6813; H01R 24/58; H01R 13/639
(Continued)

(56) References Cited

U.S. PATENT DOCUMENTS 4,627,681 A * 12/1986 Hong ..... H01R 13/193 439/263
5,073,124 A * 12/1991 Powell ..... H01R 13/035 200/83 B
(Continued)

FOREIGN PATENT DOCUMENTS

CN 1661864 A 8/2005
CN 102457793 A 5/2012

OTHER PUBLICATIONS

International Search Report for International Application No. PCT/CN2012/086051, Date of Completion of Search: Jul. 8, 2013, 3 pages.
(Continued)

*Primary Examiner* — Felix O Figueroa
(74) *Attorney, Agent, or Firm* — Locke Lord LLP

(57) ABSTRACT

An apparatus comprising: a socket cavity extending longitudinally and configured to receive a plug inserted longitudinally through an aperture; a first socket contact positioned within the socket cavity; an actuator configured to automatically switch the apparatus from a first configuration to a second configuration, when the plug is inserted longitudinally beyond a threshold insertion distance at which a tip of the plug has been inserted past the first socket contact and a first plug contact is positioned adjacent the first socket contact, wherein, in the first configuration, the first socket contact is laterally retracted from an insertion path of the plug through the socket cavity and wherein, in the second configuration, the first socket contact laterally extended towards the plug to form an electrical connection with the first plug contact.

28 Claims, 9 Drawing Sheets

(51) Int. Cl.
*H01R 12/82* (2011.01)
*H01R 29/00* (2006.01)
*H01R 13/639* (2006.01)
*H01R 107/00* (2006.01)

(52) U.S. Cl.
CPC ..... *H01R 13/639* (2013.01); *H01R 29/00* (2013.01); *H01R 2107/00* (2013.01)

(58) Field of Classification Search
USPC ..... 200/51.09, 51.12, 51.07; 439/263, 265, 439/270, 268
See application file for complete search history.

(56) References Cited

U.S. PATENT DOCUMENTS 5,102,346 A * 4/1992 Soes ..... H01R 13/193 439/264
5,514,001 A * 5/1996 Szegda ..... H01R 13/193 439/259
6,416,342 B2 * 7/2002 Matsumura ..... H01R 12/87 439/267
6,485,318 B1 * 11/2002 Schoepf ..... H01R 13/193 439/187
8,282,420 B2 * 10/2012 Healey ..... H01R 13/11 439/188
8,641,438 B2 * 2/2014 Kamiya ..... H01R 12/721 439/260
2005/0191887 A1 9/2005 Hsieh
2005/0265572 A1 12/2005 Hu

OTHER PUBLICATIONS

English Language Machine Translation of Chinese Patent Application Publication No. CN1661864A, 6 pages.

English Language Machine Translation of Chinese Patent Application Publication No. CN102457793A, 6 pages.

* cited by examiner

FIRST CONFIGURATION FIRST CONFIGURATION SECOND CONFIGURATION

APPARATUS FOR RECEIVING A PLUG TO FORM AN ELECTRICAL CONNECTION, A METHOD

TECHNOLOGICAL FIELD

Embodiments of the present invention relate to an apparatus for receiving a plug to form an electrical connection.

BACKGROUND

There are many circumstances where it is desirable to electrically connect an apparatus.

The apparatus may comprise a socket that receives a plug to form one or more electrical connections with one or more socket contacts.

BRIEF SUMMARY

According to various, but not necessarily all, embodiments of the invention there is provided an apparatus comprising: a socket cavity extending longitudinally and configured to receive a plug inserted longitudinally through an aperture; a first socket contact positioned within the socket cavity; an actuator configured to automatically switch the apparatus from a first configuration to a second configuration, when the plug is inserted longitudinally beyond a threshold insertion distance at which a tip of the plug has been inserted past the first socket contact and a first plug contact is positioned adjacent the first socket contact, wherein, in the first configuration, the first socket contact is laterally retracted from an insertion path of the plug through the socket cavity and wherein, in the second configuration, the first socket contact is laterally extended towards the plug to form an electrical connection with the first plug contact.

According to various, but not necessarily all, embodiments of the invention there is provided an apparatus comprising: a socket cavity extending longitudinally and configured to receive a plug inserted longitudinally through an aperture; a first socket contact positioned within the socket cavity at a first height; a second socket contact positioned within the socket cavity at a second height; a third socket contact positioned within the socket cavity at a third height; an actuator configured to automatically switch the apparatus from a first configuration to a second configuration, when the plug is inserted longitudinally beyond a threshold insertion distance at which:

- a tip of the plug has been inserted past the first socket contact, the second socket contact and the third socket contact,
- a first plug contact is positioned adjacent the first socket contact,
- a second plug contact is positioned adjacent the second socket contact, and
- a third plug contact is positioned adjacent the third socket contact, wherein, in the first configuration, the first socket contact, the second socket contact and the third socket contact are laterally retracted from an insertion path of the plug through the socket cavity and wherein, in the second configuration, the first socket contact laterally extends towards the plug to form an electrical connection with the first plug contact, the second socket contact laterally extends towards the plug to form an electrical connection with the second plug contact, and the third socket contact laterally extends towards the plug to form an electrical connection with the third plug contact.

According to various, but not necessarily all, embodiments of the invention there is provided a method comprising: automatically switching, from a first configuration where a first socket contact, positioned within a socket cavity extending longitudinally, is laterally retracted from a longitudinal insertion path of a plug through the socket cavity to a second configuration where the first socket contact laterally extends towards the plug to form an electrical connection with a first plug contact, when the plug is inserted longitudinally beyond a threshold insertion distance at which a tip of the plug has been inserted past the first socket contact and the first plug contact is positioned adjacent the first socket contact.

BRIEF DESCRIPTION

For a better understanding of various examples of embodiments of the present invention reference will now be made by way of example only to the accompanying drawings in which.

DETAILED DESCRIPTION

Figures 1A, 1B, 1C:
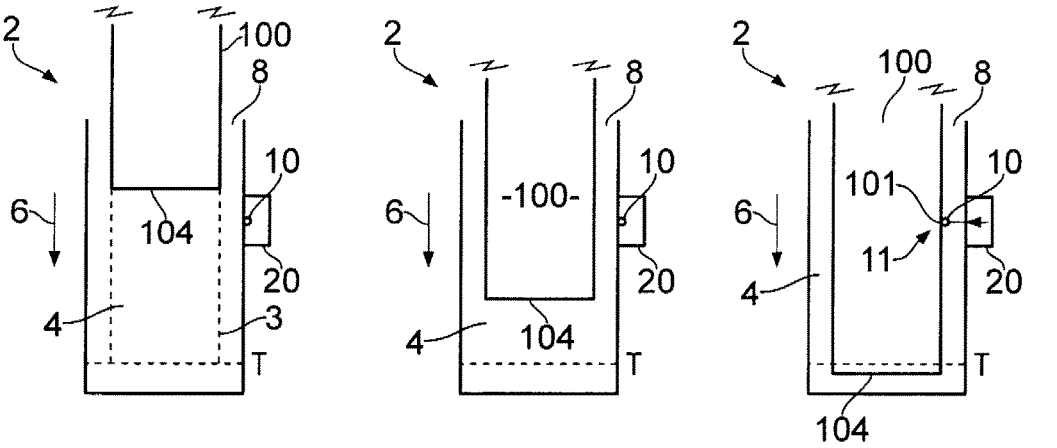
FIGS. 1A, 1B and 1C illustrate an example of an apparatus.

The Figures illustrate an apparatus 2 comprising: a socket cavity 4 extending longitudinally and configured to receive a plug 100 inserted longitudinally through an aperture 8; a first socket contact 10 positioned within the socket cavity 4; and an actuator 40 configured to automatically switch the apparatus 2 from a first configuration to a second configuration, when the plug 100 is inserted longitudinally beyond a threshold insertion distance T at which a tip 104 of the plug 100 has been inserted past the first socket contact 10 and a first plug contact 101 is positioned adjacent the first socket contact 10, wherein, in the first configuration, the first socket contact 10 is laterally retracted from an insertion path 3 of the plug 100 through the socket cavity 4 and wherein, in the second configuration, the first socket contact 10 is laterally extended towards the plug 100 to form an electrical connection 11 with the first plug contact 101.

The actuator 40 may be configured to automatically switch the apparatus 2 from the second configuration to the first configuration, when the plug is pulled longitudinally out, past the threshold insertion distance T. That is, the operation of the actuator 40 may be reversible.

The apparatus 2 is configured to receive a plug to form an electrical connection. The plug can also be removed to break the electrical connection. The cycle of insertion and removal of the same plug 100 or different plugs 100 may be repeated many thousands of times during the working life of the apparatus 2. The retraction of the first socket contact 10 during insertion (and removal) of a plug 100 reduces friction wear to the plug 100 and socket contacts 10. This extends the working life of the apparatus 2.

The apparatus 2 may, for example, enter the second configuration many thousands of times, perhaps more than 16 thousand times, and still laterally extend the first socket contact 10 towards the plug 100 to form a low resistance (<100 mΩ) electrical connection 11 with a plug contact 101.

FIGS. 1A, 1B and 1C illustrate an example of an apparatus 2. The apparatus 2 provides a socket for receiving a plug 100 and making one or more electrical connections with the plug 100.

The apparatus 2 comprises a socket cavity 4 for receiving the plug 100. The socket cavity 4 extends in a longitudinal direction 6 and is configured to receive a plug 100 inserted in the longitudinal direction 6 through an aperture 8. The socket cavity 4 also houses other components of the apparatus such as, for example, one or more socket contacts 10.

The apparatus 2 comprises one or more socket contacts 10. In this example, a first socket contact 10 is positioned within the socket cavity 4.

The apparatus 2 also comprises an actuator 20. The actuator 20 is configured to automatically switch the apparatus 2 from a first configuration (illustrated in FIGS. 1A and 1B) to a second configuration (illustrated in FIG. 1C).

In the first configuration (e.g. FIGS. 1A, 1B), the first socket contact 10 is laterally retracted from an insertion path 3 of the plug 100 through the socket cavity 4. The insertion path 3 is defined by the volume occupied by the plug 100 as it is inserted into the socket cavity 4. If something lies within the insertion path then it would interfere with the plug 100 as it is being inserted.

In the second configuration, the first socket contact 10 is laterally extended towards the plug 100 to form an electrical connection 11 with the first plug contact 101.

The actuator 20 is configured to automatically switch the apparatus 2 from the first configuration to the second configuration when the plug 100 is inserted in the longitudinal direction 6 beyond the threshold insertion distance T.

When the plug has been inserted in the longitudinal direction 6 beyond a threshold insertion distance T, a tip 104 of the plug 100 has been inserted past the first socket contact 10 and a first plug contact 101 is positioned adjacent the first socket contact 10 as illustrated in FIG. 1C.

This arrangement enables insertion of the plug 100 past the first socket contact 10 without interference.

In the first configuration the plug 100 is not fastened but in the second configuration the plug 100 is fastened by the apparatus 2. This fastening may, for example, be achieved by friction between the plug 100 and the apparatus 2 at multiple different positions including friction between the first socket contact 10 and the first plug contact 101.

When the actuator 20 automatically switches the configuration of the apparatus 2 from the first configuration to the second configuration, the plug 100 may be automatically grabbed (seized suddenly) by the apparatus 2.

When the actuator 20 automatically switches the configuration of the apparatus 2 from the first configuration to the second configuration, the plug 100 may be automatically gripped (seized firmly) by the apparatus 2.

Figure 9:
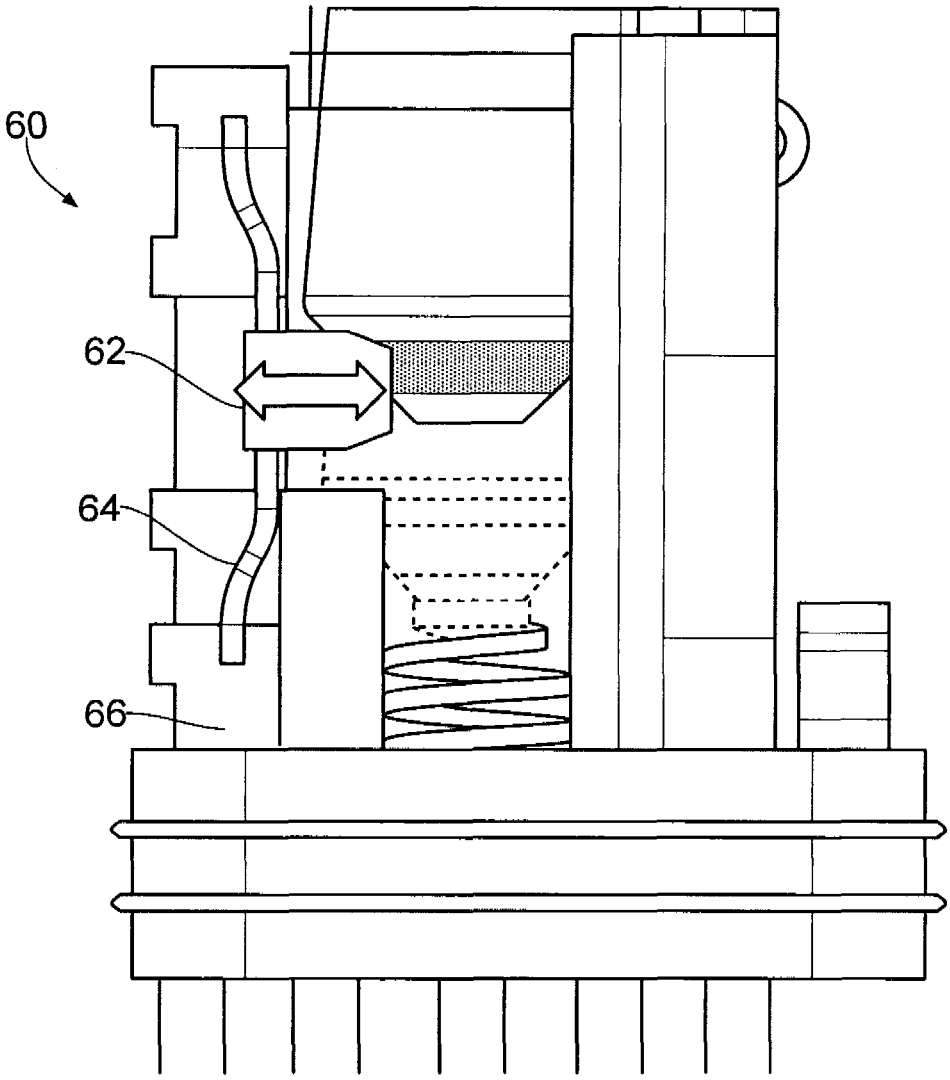
FIG. 9 illustrates an example of a mechanical fastener.

In some but not necessarily all examples, in the second configuration, the plug 100 may be held by multiple socket contacts 10 including the first socket contact 10. In some but not necessarily all examples, in the second configuration, the plug may be fastened by a mechanical fastener 60 (an example is illustrated in FIG. 9) separate to and in addition to the multiple socket contacts 10.

The actuator 20 may comprise a mechanical linkage or other transducer configured to convert a longitudinal force provided by insertion of the plug 100 to a lateral force that extends the first socket contact 10 towards the plug 100. 'Lateral' in this sense means with at least a component orthogonal to the longitudinal direction 6. An example of a suitable mechanical linkage, comprising a carriage 46 and cantilevers 12 is illustrated in the following figures.

In some but not necessarily all examples, it may be desirable for a user to experience a satisfying 'click' when the plug 100 has been inserted sufficiently to switch the configuration of the apparatus 2. For example, when the apparatus 2 is in the first configuration, as the tip 104 of the plug 100 is inserted longitudinally towards the threshold insertion distance T, a resistance to insertion of the plug 100 increases as the tip of the plug approaches the threshold insertion distance T until the actuator 40 automatically switches the apparatus 2 from the first configuration to the second configuration.

The actuator 40 may be configured to automatically switch the apparatus 2 from the second configuration to the first configuration, when the plug is pulled longitudinally past the threshold insertion distance. That is, the operation of the actuator 40 may be reversible.

Figure 2:
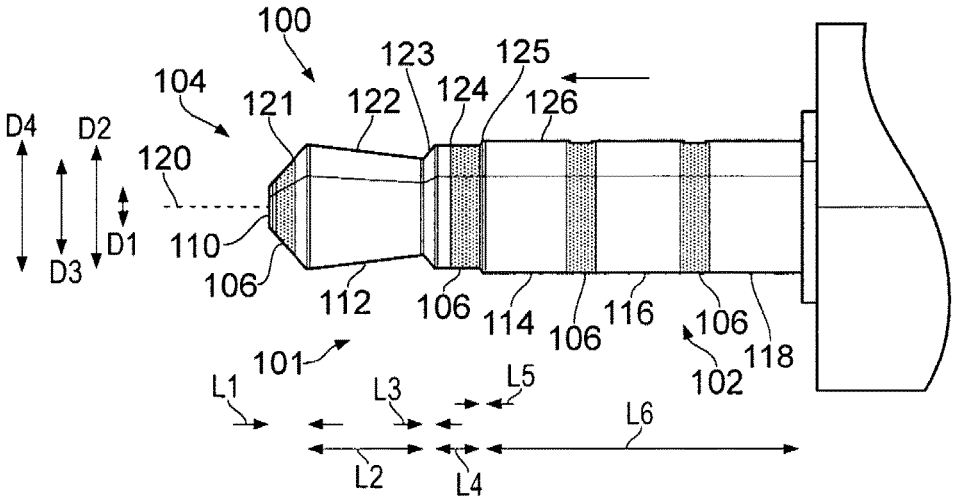
FIG. 2 illustrates an example of a plug.

FIG. 2 illustrates a plug according to some but not necessarily all examples. In this example of the plug 100, the plug 100 has a body 102 that extends longitudinally to terminate at a tip 104. The body 102 comprises multiple longitudinally separated plug contacts 101, which are individually labelled 110, 112, 114, 116, 118.

The contacts 101 may be formed from plated conductive material.

Any one of the side contacts 112, 114, 116, 118, which are positioned at a side of the body 102 may provide the above described first plug contact 101 or multiple plug contacts 101 that are electrically connected to the respective first socket contact 10 or multiple socket contacts 10.

In this example, the multiple plug contacts 101 are longitudinally separated by insulating rings of material 106 that extend circumferentially all the way around the body 102.

The plug 100 comprises a longitudinal axis 120 about which the plug 100 has rotational symmetry. Each cross-section of the body 102 of the plug 100, in a plane orthogonal to the longitudinal axis 120, has a circular perimeter.

The plug 100 has a conductive tip 104 that is flattened. The circular cross-section has a diameter D1. The tip 104 defines the plug contact 110.

The plug 100 has a forward sloping surface 121 that forms an acute angle θ with the longitudinal axis 120. The circular cross-section of the surface 121 increases from a diameter D1 to D2 over a longitudinal distance L1. This surface 121 defines a part of the plug contact 110, an insulating separator 106 and a front part of the plug contact 112.

The plug 100 next has a backward sloping surface 122 that forms an acute angle −α with the longitudinal axis 120. The circular cross-section of the surface 122 decreases, from a diameter D2 to a diameter D3, over a longitudinal distance L2 (L2>L1). This surface 122 defines a rear part of the plug contact 112.

The plug 100 next has a short forward sloping surface 123 that forms an acute angle θ with the longitudinal axis 120. The circular cross-section of the surface 123 increases from a diameter D3 to a diameter D2 over a longitudinal distance L3 (L3<L1). This surface 123 defines a part of the plug contact 112.

The plug 100 next has a short cylindrical surface 124 that has a circular cross-section of diameter D2 over a longitudinal distance L4 (l2>L4>L3). This surface 124 defines a rear part of the plug contact 112 and an insulating separator 106.

The plug 100 next has a very short forward sloping surface 125 that forms an acute angle θ with the longitudinal axis 120. The circular cross-section of the surface 125 increases from a diameter D2 to a diameter D4 over a longitudinal distance L5 (L5<L3). This surface 125 defines a part of the plug contact 1114.

The plug 100 next has a long cylindrical surface 126 having a circular cross-section of diameter D4 over a longitudinal distance L6 (L6>>L4). This surface 126 defines a part of the plug contact 114, an insulating separator 106, the plug contact 116, an insulating separator 106 and the plug contact 118.

In this example, the diameter D4 defines a diameter that is 3.5 mm.

In this example, the plug 100 is a tip (T), ring (R) and sleeve (S) plug. The tip contact is provided by plug contact 110, the ring contact is provided by plug contact 112 and one or more sleeve contacts are provided by some or all of the plug contacts 114, 116, 118.

The plug 100 may be used to transfer low power electricity to a device.

The plug 100 may be used to transfer data to and/or from a device.

In some examples, the data may be media (audio, video).

In some examples, there may be only a single sleeve contact or only two sleeve contacts. Such a plug 100 may, for example, be used for analog wired headsets, stereo headphones, and a composite video TV out cable.

In some examples, there may be three sleeve contacts (as illustrated, for example). Such a plug 100 may, for example, be used as a connector to a Universal Serial Bus (USB) male connector, as a connector to a Universal Serial Bus (USB) female connector, as a connector to a charger, as a connector to a charger adapter, and/or as a connector to a Mobile High Definition Link (MHL) cable.

The apparatus 2 may be configured to receive and use different plugs 100 that have different functions.

Thus the apparatus 2 may comprise multiple socket contacts 10 for connection to different plug contacts 101, if present on an inserted plug 100.

Figure 3A:
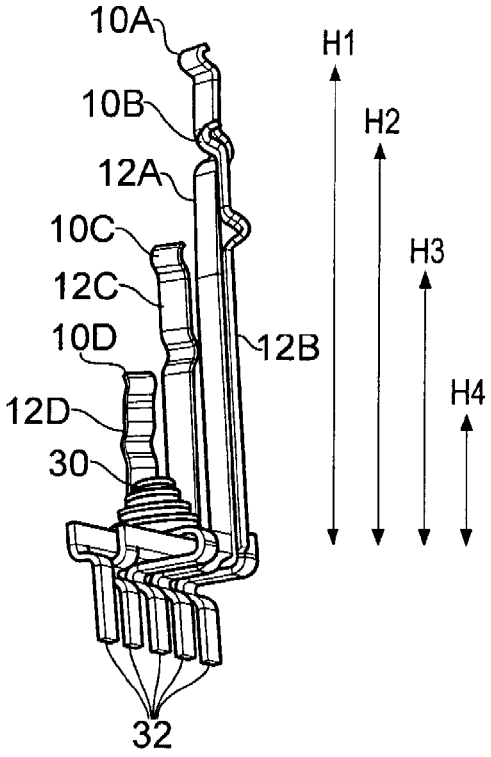
FIG. 3A illustrates an example of a contact arrangement.

FIG. 3A illustrates an example of a contact arrangement that provides multiple socket contacts 10 that are separately referenced using 10A, 10B, 10C, 10D.

It additionally provides a tip contact 30. An output pin 32 is electrically connected to each of the contacts.

The multiple socket contacts 10 are positioned at different heights and at different azimuthal angles about the longitudinal axis 120 of an inserted plug 100.

A socket contact 10A is positioned within the socket cavity at a height H1 at the end of a longitudinally extending cantilever 12A.

A socket contact 10B is positioned within the socket cavity at a height H2 at the end of a longitudinally extending cantilever 12B.

A socket contact 10C is positioned within the socket cavity at a height H3 at the end of a longitudinally extending cantilever 12C.

A socket contact 10A is positioned within the socket cavity at a height H4 at the end of a longitudinally extending cantilever 12D.

In the first configuration, all of the multiple socket contacts 10 are laterally retracted from an insertion path 3 of the plug 100 through the socket cavity 4.

Figure 3B:
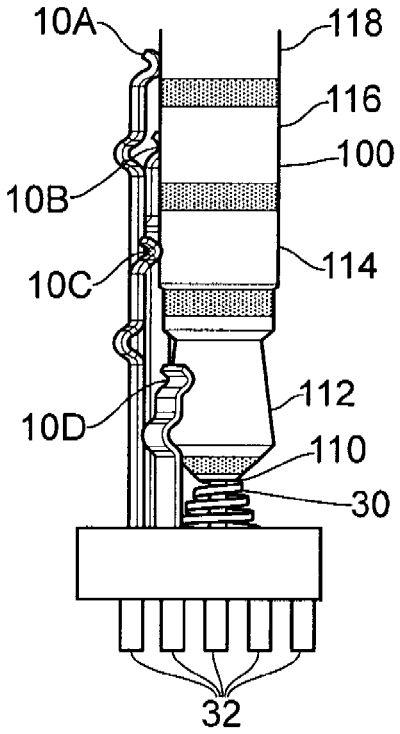
FIG. 3B illustrates the example of a contact arrangement in electrical contact with a plug.

In the second configuration, all of the multiple socket contacts 10 are laterally extended towards the inserted plug 100 to form respective, different, electrical connections 11 with different longitudinally spaced plug contacts 112, 114, 116, 118 of the plug 100. This is illustrated in FIG. 3B. Also, in the second configuration, the plug 100 is held by the multiple socket contacts 10 as a consequence of the friction between the socket contacts 10 and the plug contacts 101.

Each of the cantilevers 12, which are separately referenced using 12A, 12B. 12C, 12D, are stiff and provide a contact bias that biases their respective socket contact 10 out of the insertion path 3 of the plug 100. In the second configuration the actuator 40 pushes against the contact biases extending the socket contacts 10 laterally towards the plug 100.

The contact bias is provided by elastic deformation of the cantilever 12 supporting the socket contact 10.

Figure 4:
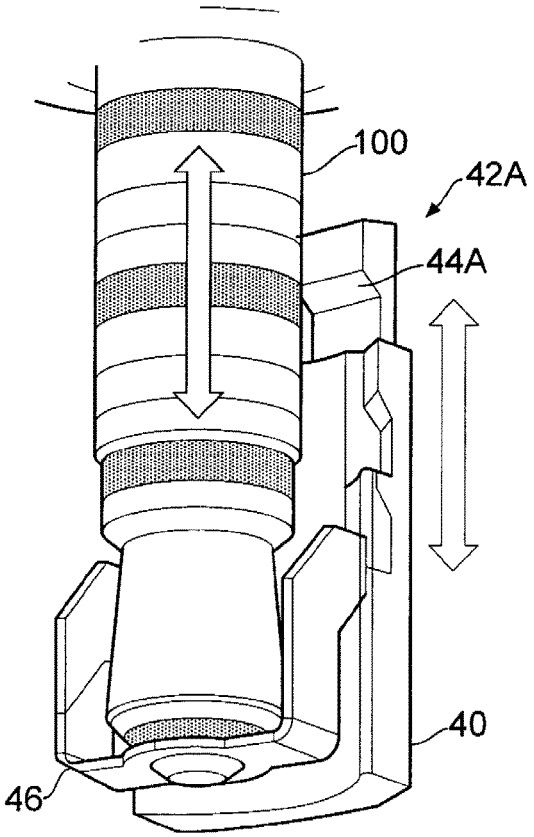
FIG. 4 illustrates an example of an actuator comprising a movable carriage.
Figure 5A:
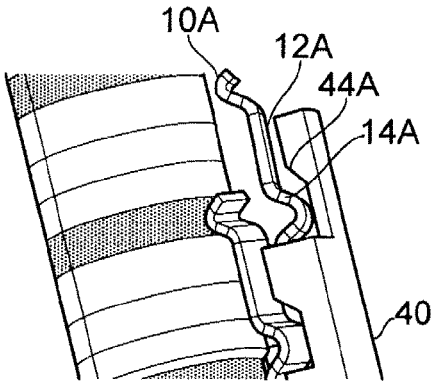
FIGS. 5A and 5B illustrate an example of a detent mechanism in a first configuration and a second configuration.
Figure 5B:
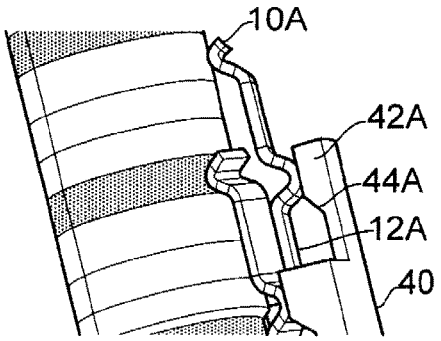

Referring to FIG. 4, FIG. 5A and FIG. 5B the actuator 40 comprises a movable carriage 46 and the cantilevers 12.

The carriage 46 is configured to slide longitudinally when pushed by the tip 104 of the plug 100. The carriage 46 comprises longitudinal extensions 42 that lie outside the insertion path 3 of the plug and define carriage abutment surfaces 44. In the example of FIGS. 5A and 5B, the longitudinal extension 42A that lies outside the insertion path 3 of the plug, defines a carriage abutment surfaces 44A.

The cantilevers 12 supporting the socket contacts 10 each comprise a cantilever abutment surface 14. In the example of FIGS. 5A and 5B, the cantilever 12A supports the socket contact 10A and comprises a cantilever abutment surface 14A.

Longitudinal movement of the carriage 46, causes the carriage abutment surfaces 44 to apply forces with lateral components to each of the cantilever abutment surfaces 14 that bend the cantilevers 12 and moves the socket contacts 10 laterally. The longitudinal extensions 42 are stiffer than the cantilevers 12.

In the example of FIGS. 5A and 5B, longitudinal movement of the carriage 46, causes the carriage abutment surface 44A to apply a force with a lateral component to the cantilever abutment surface 14A that bends the cantilever 12A and moves the socket contact 12A laterally.

The reciprocating combination of each cantilever abutment surface 14 and its respective carriage abutment surface 44 forms a detent mechanism. The carriage abutment surface 44 comprises an angled guide surface and the cantilever abutment surface 14 comprises a correspondingly angled guide surface. When the carriage 46 moves longitudinally on insertion of the plug 100, the cantilever abutment surface 14 (and the cantilever 12 itself) ride up and over the carriage abutment surface 44A.

As a result of the angled guide surfaces and the elastic deformation of the cantilever, when the tip 104 of the plug 100 is inserted longitudinally towards the threshold insertion distance T, there is an increasing resistance to insertion of the plug as the tip 104 of the plug 100 approaches the threshold insertion distance T until automatic switching of the apparatus 2 from the first configuration to the second configuration.

FIG. 5A illustrates the detent mechanism in the first configuration and FIG. 5B illustrates the detent mechanism in the second configuration.

The multiple socket contacts 10 may be configured to form respective, different, electrical connections 11 with different longitudinally spaced plug contacts 112, 114, 116, 118, in a predefined temporal order. For example, the socket contact 10 that is configured to provide ground forms a connection 11 first, then the socket contact 10 that is configured to provide power forms a connection 11, and then the socket contact 10 or socket contacts 10 that are configured to transfer data via a connection 11 or connections 11 are formed.

The temporal order of forming connections may, for example, be controlled by controlling the respective timing of the actuation of the respective socket contacts 10. This may, for example, be achieved by having different relative longitudinal spacing between the cantilever abutment surfaces 14 and the carriage abutment surfaces 44 for different ones of the cantilevers 12 associated with different ones of the socket contacts 10.

Figure 6:
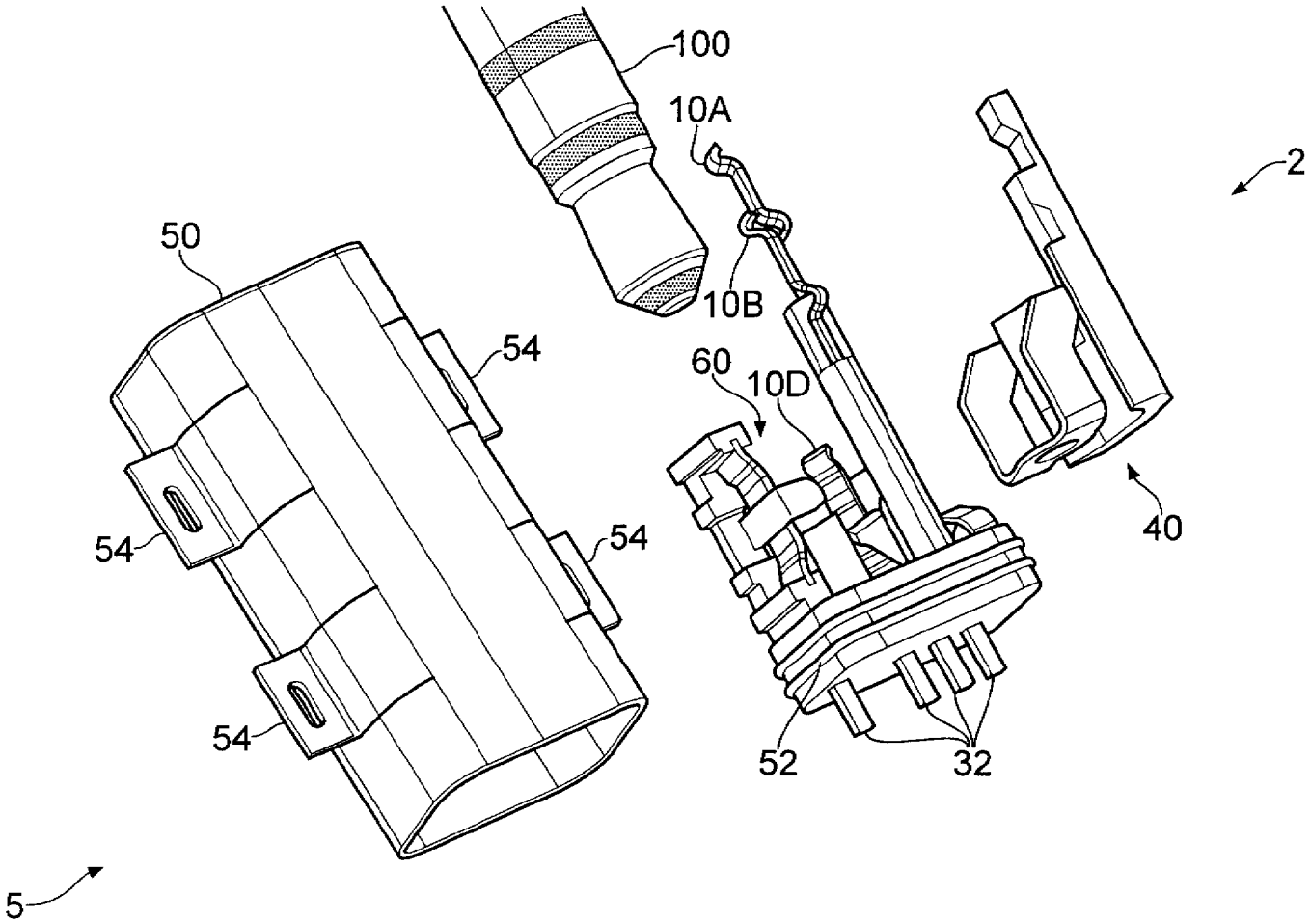
FIG. 6 illustrates, in an exploded view, an example of the apparatus when configured as a module.

FIG. 6 illustrates, in an exploded view, the apparatus 2 when configured as a module 5.

The module 5 comprises an external housing 50. The external housing, in this example, comprises fixing brackets 54.

The socket contacts are mounted on a carrier 52 which fits into a cavity within the housing 50. The carrier 52 seals an aperture to the cavity. External pins 32 are connected to respective socket contacts 10.

The apparatus 2 may be a module 5 in an electronic device or an electronic device. Examples of electronic device, include by way of example, non-portable and portable electronic devices such as, but not limited to: mobile cellular telephone, computer, laptop, tablet, personal digital assistant, desktop computer, base station, and/or other fixed or portable electronic equipment.

Figure 7:
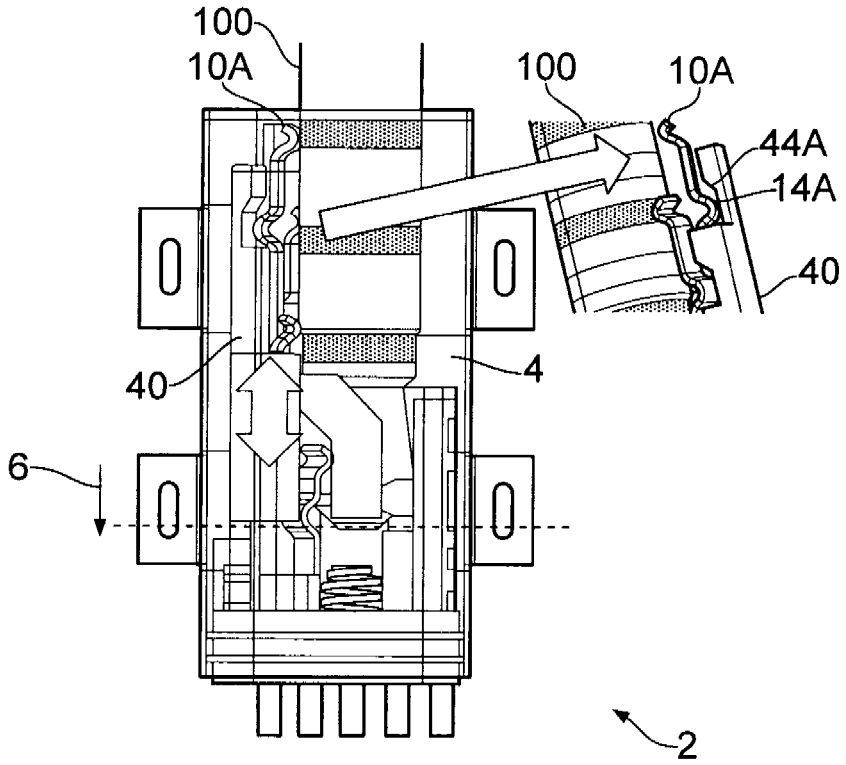
FIG. 7 illustrates an example of a first configuration of the apparatus.
Figure 8:
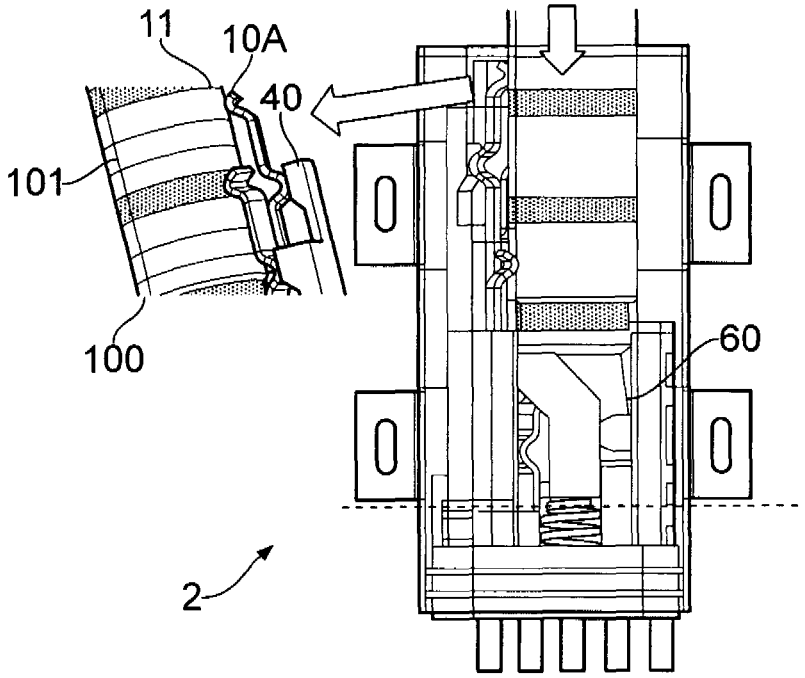
FIG. 8 illustrates an example of a second configuration of the apparatus.

FIGS. 7 and 8 illustrate a method comprising: automatically switching, from a first configuration (FIG. 7) to a second configuration (FIG. 8). The switch occurs when the plug 100 is inserted longitudinally beyond a threshold insertion distance at which a tip of the plug 100 has been inserted past the socket contact 10A and the plug contact 101 is positioned adjacent the socket contact 10A.

In the first configuration (FIG. 7) the socket contact 10A, positioned within the socket cavity 4 extending in a longitudinal a direction 6, is laterally retracted from the longitudinal insertion path of the plug 100 through the socket cavity 4.

In the second configuration (FIG. 8) the socket contact 10A laterally extends towards the plug 100 to form an electrical connection 11 with the plug contact 101.

FIG. 7 illustrates an apparatus 2 during insertion of a plug 100 while the apparatus 2 is in the first configuration. In the first configuration, all of the multiple socket contacts 10 are laterally retracted from the insertion path 3, through the socket cavity 4, of the plug 100.

FIG. 8 illustrates an apparatus 2 after insertion of a plug 100 has switched the apparatus 2 to the second configuration. In the second configuration, all of the multiple socket contacts 10 are laterally extended towards the inserted plug 100 to form respective, different, electrical connections 11 with different longitudinally spaced plug contacts 101 of the plug 100.

Contact biases bias the respective socket contacts 10 out of the insertion path 3 of the plug 100. In the second configuration the actuator 40 pushes against the contact biases extending the socket contact 10 laterally towards the plug 100. The contact bias is provided by elastic deformation of the cantilevers 12 supporting the socket contacts 10. Longitudinal movement of the carriage 46 causes the carriage abutment surfaces 44 to apply forces with lateral components to each of the cantilever abutment surfaces 14 that bend the cantilevers 12 and move the socket contacts 10 laterally.

In the second configuration, the plug 100 is held by the multiple socket contacts 10 as a consequence of the friction between the socket contacts 10 and the plug contacts 101.

FIG. 9 illustrates a mechanical fastener 60 that additionally holds the plug 100 in the second configuration.

The fastener 60 operates as a friction fit. A support 66 supports a spring bias 64 that biases a lug 62 into the insertion path 3 of the plug 100. The plug 100 when fully inserted deflects the lug, against its bias. The force provided by the bias spring 64 to the plug 100 through the lug 62 holds the plug 100.

Figure 10:
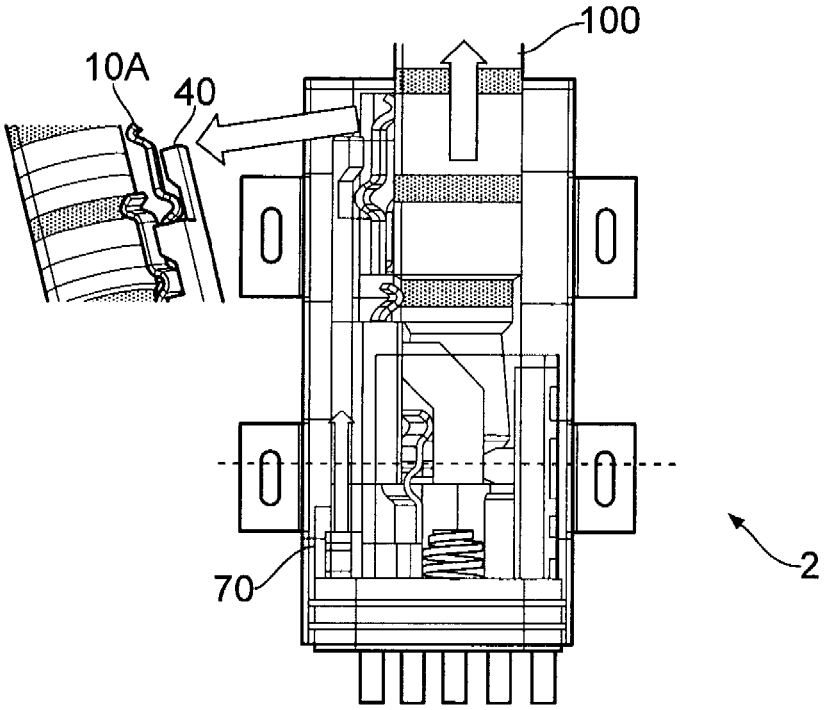
FIG. 10 illustrates an example of an apparatus during removal of the plug.

FIG. 10 illustrates an apparatus 2 during removal of the plug 100. The apparatus 2 has switched to the first configuration. In the first configuration, all of the multiple socket contacts 10 are laterally retracted from the insertion path 3, through the socket cavity 4, of the plug 100.

A spring 70 may be used to move the carriage 46. The spring 70 is compressed when the plug 100 is inserted and the stored energy is released when the plug 100 is removed to move the carriage 46.

Figure 11:
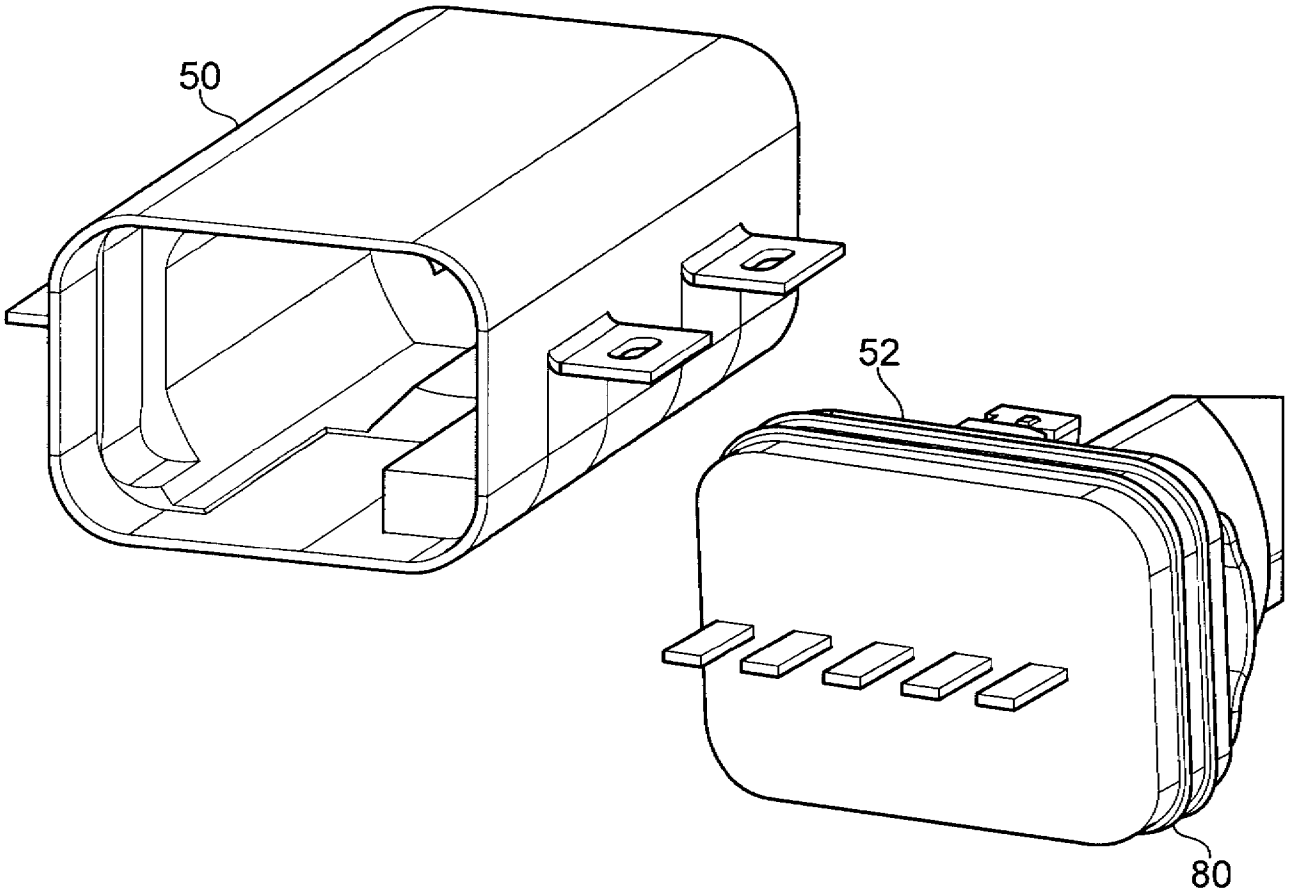
FIG. 11 illustrates an example of a module.

FIG. 11 illustrates a module 5 similar to that illustrated in FIG. 6.

The carrier 52 comprises waterproof seals 80 around its perimeter which form a waterproof seal at the aperture to the cavity of the external housing 50.

Although embodiments of the present invention have been described in the preceding paragraphs with reference to various examples, it should be appreciated that modifications to the examples given can be made without departing from the scope of the invention as claimed.

As used here 'module' refers to a unit or apparatus that excludes certain parts/components that would be added by an end manufacturer or a user.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A system comprising:

a plug, wherein the plug has a body that extends longitudinally to terminate at a tip and that comprises multiple longitudinally separated plug contacts;

the system further comprising:

a socket cavity extending longitudinally and configured to receive the plug inserted longitudinally through an aperture;

a first socket contact positioned within the socket cavity;

an actuator configured to automatically switch the apparatus from a first configuration to a second configuration, when the plug is inserted longitudinally beyond a threshold insertion distance at which a tip of the plug has been inserted past the first socket contact and a first plug contact is positioned adjacent the first socket contact, wherein, in the first configuration, the first socket contact is laterally retracted from an insertion path of the plug through the socket cavity and wherein, in the second configuration, the first socket contact is laterally extended towards the plug to form an electrical connection with the first plug contact.

2. The system as claimed in claim 1, wherein when the apparatus is in the first configuration, as the tip of the plug is inserted longitudinally towards the threshold insertion distance, a resistance to insertion of the plug increases as the tip of the plug approaches the threshold insertion distance until the actuator automatically switches the apparatus from the first configuration to the second configuration.

3. The system as claimed in claim 1, wherein in the first configuration the plug is not fastened and wherein in the second configuration the plug is fastened by the apparatus.

4. The system as claimed in claim 1, wherein when the actuator automatically switches the configuration of the apparatus from the first configuration to the second configuration, the plug is automatically grabbed by the apparatus.

5. The system as claimed in claim 1, wherein when the actuator automatically switches the configuration of the apparatus from the first configuration to the second configuration, the plug is automatically gripped by the apparatus.

6. The system as claimed in claim 1, wherein in the second configuration the plug is held by multiple socket contacts including the first socket contact.

7. The system as claimed in claim 6, wherein, in the first configuration, all of the multiple socket contacts are laterally retracted from an insertion path of the plug through the socket cavity and wherein, in the second configuration, all of the multiple socket contacts are laterally extended towards the plug to form respective, different, electrical connections with different longitudinally spaced parts of the plug.

8. The system as claimed in claim 6, wherein the multiple socket contacts are positioned at different heights and at different azimuthal angles.

9. The system as claimed in claim 6, wherein the multiple socket contacts are configured to form respective, different, electrical connections with different longitudinally spaced parts of the plug, in a predefined temporal order.

10. The system as claimed in claim 9, wherein the predefined temporal order is: the socket contact that is configured to provide ground, the socket contact that is configured to provide power, and the socket contact or socket contacts that are configured to provide data.

11. The system as claimed in claim 6, wherein in the second configuration the plug is fastener by a mechanical fastener separate to and in addition to the multiple socket contacts.

12. The system as claimed in claim 1, wherein the actuator is configured to automatically switch the apparatus from the second configuration to the first configuration, when the plug is pulled longitudinally past the threshold insertion distance.

13. The system as claimed in claim 1, wherein the actuator comprises a transducer configured to convert a longitudinal force provided by insertion of the plug to a lateral force that extends the first socket contact towards the plug.

14. The system as claimed in claim 1, wherein a contact bias biases the first socket contact out of the insertion path of the plug.

15. The system as claimed in claim 14, wherein in the second configuration the actuator pushes against the contact bias extending the first socket contact laterally towards the plug.

16. The system as claimed in claim 14, wherein the contact bias is provided by elastic deformation of a cantilever supporting the first socket contact.

17. The system as claimed in claim 1, wherein the actuator comprises:

a carriage configured to slide longitudinally when pushed by the plug, wherein the carriage comprises a carriage abutment surface; and a cantilever supporting the first socket contact, wherein the cantilever comprises a cantilever abutment surface;

wherein longitudinal movement of the carriage, causes the carriage abutment surface to apply a force with a lateral component to the cantilever abutment surface that bends the cantilever and moves the first socket contact laterally.

18. The system as claimed in claim 17, wherein the carriage abutment surface comprises an angled guide surface and wherein the cantilever abutment surface comprises a correspondingly angled guide surface.

19. The system as claimed in claim 1, configured as a module comprising an external housing and external pins connected to respective socket contacts.

20. The system as claimed in claim 1, configured as an electronic device.

21. The system as claimed in claim 1, wherein the multiple plug contacts are longitudinally separated by insulating rings of material.

22. The system as claimed in claim 1, wherein the plug comprises a longitudinal axis about which the plug has rotational symmetry.

23. The system as claimed in claim 22, wherein the body of the plug has a cross-section orthogonal to the longitudinal axis that varies.

24. An apparatus comprising:

a socket cavity extending longitudinally and configured to receive a plug inserted longitudinally through an aperture;

a first socket contact positioned within the socket cavity at a first height;

a second socket contact positioned within the socket cavity at a second height;

a third socket contact positioned within the socket cavity at a third height;

an actuator configured to automatically switch the apparatus from a first configuration to a second configuration, when the plug is inserted longitudinally beyond a threshold insertion distance at which:

a tip of the plug has been inserted past the first socket contact, the second socket contact and the third socket contact, a first plug contact is positioned adjacent the first socket contact, a second plug contact is positioned adjacent the second socket contact, and a third plug contact is positioned adjacent the third socket contact, wherein, in the first configuration, the first socket contact, the second socket contact and the third socket contact are laterally retracted from an insertion path of the plug through the socket cavity and wherein, in the second configuration, the first socket contact laterally extends towards the plug to form an electrical connection with the first plug contact, the second socket contact laterally extends towards the plug to form an electrical connection with the second plug contact, and the third socket contact laterally extends towards the plug to form an electrical connection with the third plug contact.

25. An apparatus as claimed in claim 24, comprising: a first longitudinally extending cantilever, a second longitudinally extending cantilever and a third longitudinally extending cantilever, wherein the first socket contact is positioned within the socket cavity at a first height by the first longitudinally extending cantilever; the second socket contact is positioned within the socket cavity at a second height, different to the first height, by the second longitudinally extending cantilever; and the third socket contact is positioned within the socket cavity at a third height, different to the first height and the second height, by the third longitudinally extending cantilever.

26. An apparatus as claimed in claim 25, wherein the actuator comprises a carriage that is configured to move longitudinally to automatically switch the apparatus from the first configuration to the second configuration, by bending the first, second and third longitudinally extending cantilevers.

27. A method comprising:

automatically switching, from a first configuration where a first socket contact, positioned within a socket cavity extending longitudinally, is laterally retracted from a longitudinal insertion path of a plug through the socket cavity to a second configuration where the first socket contact laterally extends towards the plug to form an electrical connection with a first plug contact, when the plug is inserted longitudinally beyond a threshold insertion distance at which a tip of the plug has been inserted past the first socket contact and the first plug contact is positioned adjacent the first socket contact, wherein the plug has a body that extends longitudinally to terminate at a tip and that comprises multiple longitudinally separated plug contacts.

28. A method as claimed in claim 27, wherein, in the first configuration, as the tip of the plug is inserted longitudinally towards the threshold insertion distance, causing a resistance to insertion of the plug to increase as the tip of the plug approaches the threshold insertion distance until automatic switching of the apparatus from the first configuration to the second configuration.

* * * * *